US006729399B2

(12) United States Patent
Follini et al.

(10) Patent No.: US 6,729,399 B2
(45) Date of Patent: May 4, 2004

(54) METHOD AND APPARATUS FOR DETERMINING RESERVOIR CHARACTERISTICS

(75) Inventors: Jean-Marc Follini, Houston, TX (US); Julian Pop, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 147 days.

(21) Appl. No.: 09/994,198

(22) Filed: Nov. 26, 2001

(65) Prior Publication Data

US 2003/0098156 A1 May 29, 2003

(51) Int. Cl.[7] ..... E21B 49/10

(52) U.S. Cl. ..... 166/264; 166/250.17; 73/152.19

(58) Field of Search ..... 166/100, 187, 166/191, 250.07, 250.17, 264; 73/152.19, 152.24, 152.26

(56) References Cited

U.S. PATENT DOCUMENTS

| | | | | |
|---|---|---|---|---|
| 4,043,192 A | | 8/1977 | Shuck | |
| 4,210,018 A | * | 7/1980 | Brieger | 73/155 |
| 4,745,802 A | | 5/1988 | Purfurst | |
| 4,879,900 A | * | 11/1989 | Gilbert | 73/155 |
| 5,065,619 A | * | 11/1991 | Myska | 73/152 |
| 5,242,020 A | | 9/1993 | Cobern | |
| 5,602,334 A | * | 2/1997 | Proett et al. | 73/152.05 |
| 5,770,798 A | | 6/1998 | Georgi et al. | |
| 5,789,669 A | | 8/1998 | Flaum | |
| 5,803,186 A | | 9/1998 | Berger et al. | |
| 5,969,241 A | | 10/1999 | Auzerais | |
| 6,026,915 A | | 2/2000 | Smith et al. | |
| 6,047,239 A | | 4/2000 | Berger et al. | |
| 6,157,893 A | | 12/2000 | Berger et al. | |
| 6,179,066 B1 | | 1/2001 | Nasr et al. | |
| 6,230,557 B1 | | 5/2001 | Ciglenec et al. | |
| 2002/0062958 A1 | | 5/2002 | Diener et al. | |
| 2002/0062992 A1 | | 5/2002 | Fredericks et al. | |

FOREIGN PATENT DOCUMENTS

| | | |
|---|---|---|
| EP | 0 697 501 | 2/1996 |
| EP | 0 909 877 A1 | 4/1999 |
| EP | 0 978 630 A2 | 2/2000 |
| EP | 0 978 630 A3 | 12/2001 |
| WO | WO 00/43812 | 7/2000 |

* cited by examiner

*Primary Examiner*—Frank Tsay
(74) *Attorney, Agent, or Firm*—Jennie (JL) Salazar; Brititte L. Jeffery; John J. Ryberg

(57) ABSTRACT

A downhole tool for collecting data from a subsurface formation is disclosed. The tool is provided with a probe for testing and/or sampling an adjacent formation. The tool is also provided with a protector positioned about the probe for engaging and protecting the sidewall of the bore hole surrounding the probe. The protector prevents deterioration of the wellbore during the testing and/or sampling by the probe.

28 Claims, 8 Drawing Sheets

METHOD AND APPARATUS FOR DETERMINING RESERVOIR CHARACTERISTICS

FIELD OF THE INVENTION

This invention relates generally to the determination of various parameters in a subsurface formation penetrated by a wellbore. More particularly, this invention relates to the determination of formation parameters through the use of an evaluation tool featuring one or more devices that can protect the tool and/or the wellbore during evaluation.

BACKGROUND OF THE INVENTION

Typical drilling techniques use a special fluid (drilling mud) that provides many important benefits to the drilling process, such as cooling the drilling bit, carrying the drilled cuttings to the surface, reducing the pipe friction and the risk of pipe sticking, and in some instances powering a downhole drilling motor (mud motor). Another important function of the drilling mud is to hydraulically isolate the well bore by allowing some of its content to slowly build an isolating layer (mud cake) over the well bore internal surface, thus protecting the sub surface formations from being invaded by the aforementioned drilling fluids.

It is known in the art of formation pressure measurement that the quality of such formation pressure measurements is dependant on the presence of a tight, impermeable mudcake. It is also known in the art of formation pressure measurement that the integrity of such mudcake is reduced by the dynamic erosion generated by the drilling mud being circulated in the annular space between the drilling pipe and the borehole. A consequence of this latter effect, usually called supercharging, leads to pressure measurements that are not representative of the surrounding formation. It is also known in the art of well drilling that maintaining drilling mud circulation at all times during the drilling process is desirable for its positive effects on reducing pipe sticking and the ability to control the behavior and the stability of the borehole.

Oil well operation and production, known in the art, involves monitoring of various subsurface formation parameters. One aspect of formation evaluation is concerned with the parameters of reservoir pressure and the permeability of the reservoir rock formation. Periodic monitoring of parameters such as reservoir pressure and permeability indicate the formation pressure change over a period of time, which is needed to predict the production capacity and lifetime of a subsurface formation. Present day operations typically obtain these parameters through wireline logging via a "formation tester" tool. This type of measurement requires a supplemental "trip", in other words, removing the drill string from the wellbore, running a formation tester into the wellbore to acquire the formation data and, after retrieving the formation tester, running the drill string back into the wellbore for further drilling.

The availability of reservoir formation data on a "real time" basis during well drilling activities can be a valuable asset. Real time formation pressure obtained while drilling will allow a drilling engineer or driller to make decisions concerning changes in drilling mud weight and composition as well as borehole penetration parameters at a much earlier time to thus promote the safety aspects of drilling. The availability of real time reservoir formation data is also desirable to enable precision control of drill bit weight in relation to formation pressure changes and changes in permeability so that the drilling operation can be carried out at its maximum efficiency.

It is also possible to obtain reservoir formation data while the drill string with its drill collars, drill bit and other drilling components are present within the well bore, thus eliminating or minimizing the need for tripping the well drilling equipment for the sole purpose of running formation testers into the wellbore for identification of these formation parameters.

Various devices have been developed to evaluate formations, such as the devices disclosed in U.S. Pat. Nos. 5,242,020, issued to Cobern; 5,803,186, issued to Berger et al.; 6,026,915, issued to Smith et al.; 6,047,239, issued to Berger et al.; 6,157,893, issued to Berger et al.; 6,179,066, issued to Nasr et al.; and 6,230,557, issued to Ciglenec et al. These patents disclose various downhole tools and methods for collecting data from a subsurface formation. At least some of these devices relate to downhole testing tools with probes having sealing and/or extension mechanisms that enable the probe to contact the borehole.

While tools have been developed to improve contact with the borehole during sampling and/or testing, there remains a need to protect the probe and/or borehole surrounding the testing area to prevent erosion during data collection. It is, therefore, desirable to have a wellbore instrument, such as a formation fluid pressure testing and/or sampling device, which protects the wellbore as tests are performed and/or samples taken.

SUMMARY OF INVENTION

An aspect of the invention relates to a downhole tool for collecting data from a subsurface formation. The tool comprises a housing, a probe and a protector. The housing is positionable in a wellbore penetrating the subsurface formation. The probe is carried by the housing and extendable therefrom. The probe is positionable adjacent to the sidewall of the wellbore and is adapted to engage the formation. The protector is positioned about the probe and adapted for movement between a retracted position adjacent to the housing and an extended position engaging the sidewall of the wellbore. The protector has an outer surface adapted to engage the sidewall of the wellbore whereby the wellbore surrounding the probe is protected.

Another aspect of the invention relates to a downhole tool for collecting data from a subsurface formation. The tool includes a housing adapted for axial connection in a drill string positioned in a wellbore penetrating the subsurface formation. The tool also includes a first actuator system carried at least partially by the housing. The tool also includes a probe carried by the housing that is adapted for movement by the first actuator system between a retracted position within the housing and an extended position sealingly engaging the wellbore wall. The tool also includes a protector positioned about the probe, the protector operatively coupled to a second actuator, wherein the protector is adapted for movement by the second actuator system between a retracted position adjacent to the housing and an extended position engaging the wellbore wall such that the protector engages the wellbore wall.

Another aspect of the invention relates to a method for measuring a property of fluid present in a subsurface formation. A downhole tool is positioned in a wellbore penetrating the subsurface formation, the downhole tool having a probe extendable therefrom. The probe is moved into sealed engagement with the wellbore wall. A protector is positioned into sealed engagement with the wellbore wall surrounding the probe. Data is collected from the formation.

Other aspects of the invention will become apparent from the following discussion.

BRIEF DESCRIPTION OF DRAWINGS

So that the manner in which the above recited features and advantages of the present invention are attained can be understood in detail, a more particular description of the invention, briefly summarized above, may be had by reference to the preferred embodiments thereof which are illustrated in the appended drawings.

It is to be noted however, that the appended drawings illustrate only typical embodiments of this invention and are therefore not to be considered limiting of its scope, for the invention may admit to other equally effective embodiments.

In the drawings:

FIG. 1 is an elevational view, partially in section and partially in block diagram, of a conventional drilling rig and drill string employing a downhole evaluation tool in accordance with the present invention;

FIG. 2 is a schematic side view of the evaluation tool of FIG. 1;

FIG. 3 is a side view of the evaluation tool of FIG. 1;

FIG. 4 is a cross sectional view of the evaluation tool of FIG. 3 taken along line 4—4;

FIG. 5 is a cross sectional view of the evaluation tool of FIG. 3 taken along line 5—5;

FIG. 6 is a cross sectional view of an embodiment of an evaluation tool;

FIG. 7 is a cross sectional view of an embodiment of an evaluation tool having multiple probe sections;

FIG. 8 is a cross sectional view of an embodiment of an evaluation tool having a inflatable packer;

FIG. 9 is a cross sectional view of an embodiment of an evaluation tool depicting the flow patterns where a probe in contact with the sidewall of the bore hole;

FIG. 10 is a cross sectional view of an embodiment of an evaluation tool depicting the flow patterns where a protector engages the sidewall of the borehole surrounding the probe.

DETAILED DESCRIPTION

Figure 1:
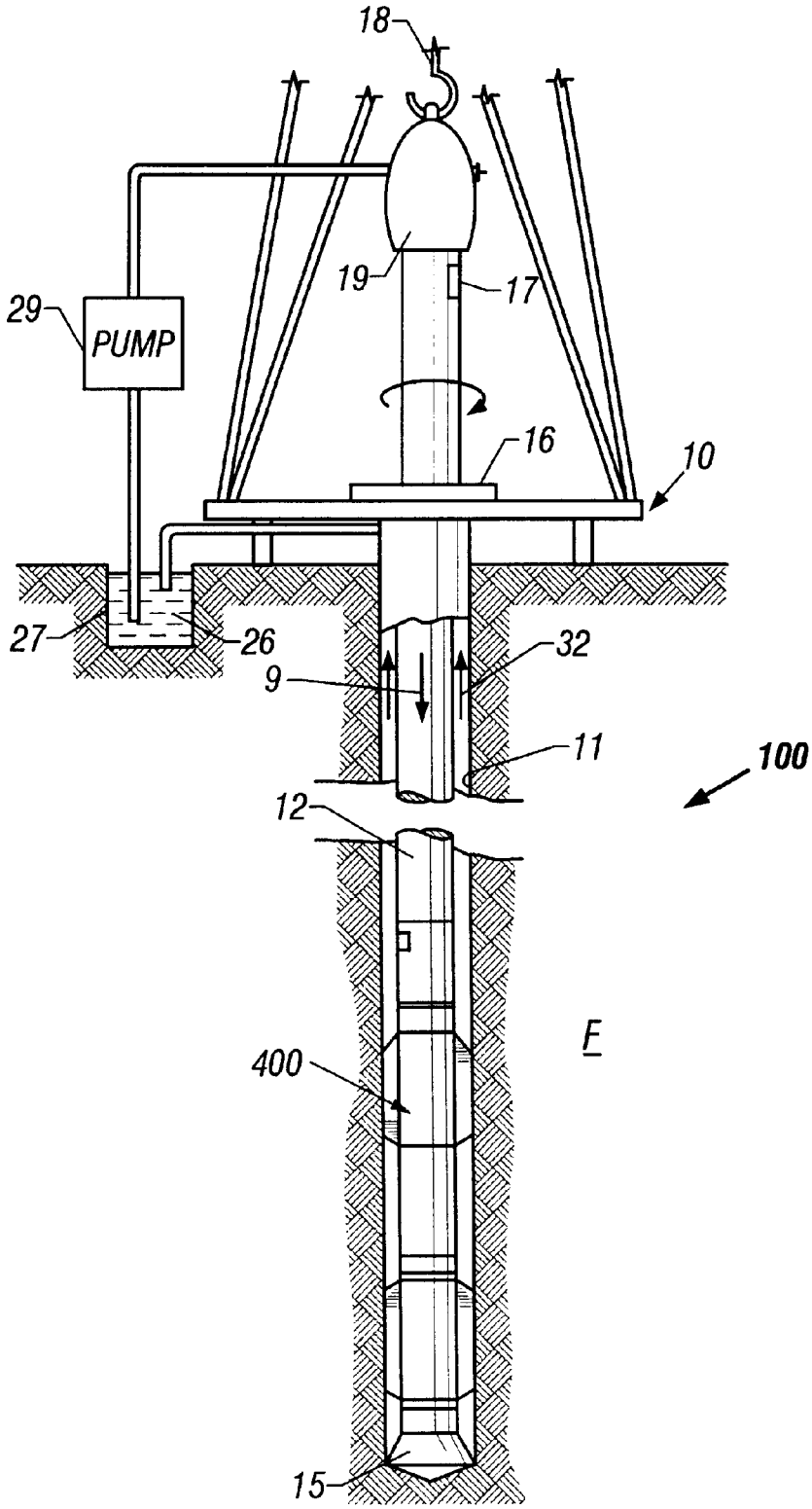

FIG. 1 illustrates a conventional drilling rig and drill string in which the present invention can be utilized. Land-based platform and derrick assembly (10) are positioned over wellbore (11) penetrating subsurface formation F. In the illustrated embodiment, wellbore (11) is formed by rotary drilling in a manner that is known in the art. Those of ordinary skill in the art given the benefit of this disclosure will appreciate, however, that the present invention also finds application in directional drilling applications as well as rotary drilling, and is not limited to land-based rigs.

Drill string (12) is suspended within wellbore (11) and includes drill bit (15) at its lower end. Drill string (12) is rotated by rotary table (16), and energized by a motor or engine or other mechanical means (not shown), which engages kelly (17) at the upper end of the drill string. Drill string (12) is suspended from hook (18), attached to a traveling block (not shown), through kelly (17) and rotary swivel (19) which permits rotation of the drill string relative to the hook.

Drilling fluid or mud (26) is stored in pit (27) formed at the well site. Pump (29) delivers drilling fluid (26) to the interior of drill string (12) via a port in swivel (19), inducing the drilling fluid to flow downwardly through drill string (12) as indicated by directional arrow (9). The drilling fluid exits drill string (12) via ports in drill bit (15), and then circulates upwardly through the region between the outside of the drillstring and the wall of the wellbore, called the annulus, as indicated by direction arrows (32). In this manner, the drilling fluid lubricates drill bit (15) and carries formation cuttings up to the surface as it is returned to pit (27) for recirculation.

Drillstring (12) further includes a bottom hole assembly, generally referred to as bottom hole assembly (100), near the drill bit (15) (for example, within several drill collar lengths from the drill bit). The bottom hole assembly (100) may include capabilities for measuring, processing, and storing information, as well as communicating with the surface.

Drill string (12) is further equipped in the embodiment of FIG. 1 with collar (400). Such collars may be utilized as a housing for one or more tools or for stabilization, e.g.—to address the tendency of the drill string to "wobble" and become decentralized as it rotates within the wellbore, resulting in deviations in the direction of the wellbore from the intended path (for example, a straight vertical line).

Figure 2:
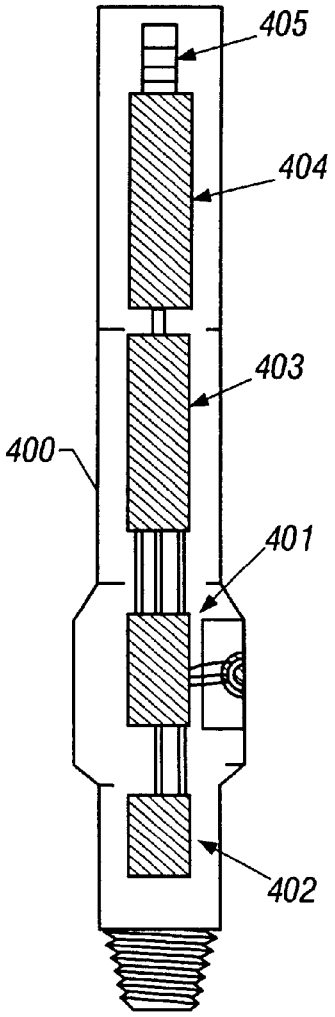

An embodiment of the invention is shown in FIG. 2. FIG. 2 illustrates an evaluation tool (400) forming part of the drill string 12 of FIG. 1. While the tool depicted in FIGS. 1 and 2 is an evaluation tool (400) connectable to a drill string, it will be appreciated that the evaluation tool (400) may also be used in connection with other downhole tools, such as wireline tools.

In the embodiment of FIG. 2, the evaluation tool (400) includes a probe section (401), a sensor section (402), a power and control section (403), an electronic section (404) and optionally other modules (not shown), each one featuring separate functions. The probe section (401) is the main component of the tool, which connects a flow line inside the tool to the formation to be evaluated. The sensor section (402) hosts the sensor(s) that will measure the properties of the formation being evaluated. Typical sensors include pressure gauges, temperature gauges, and other sensors that measure formation characteristics. Such sensors may also be used to convert the physical properties of the formation to be evaluated into signals that can be processed and communicated to other portions of the tool or uphole to, for instance, the user.

The power and control section (403) hosts the circuits and systems that will provide power to the probe section (401) and control the operation of the probe. Such systems can be based on hydraulic technology, electrical technology, or a combination of both, or other systems known in the field of logging while drilling and wireline logging. The control system may provide controls to properly deploy and operate the tool with a minimum of manual intervention from the operator located at the surface.

The electronic section (404) hosts the electrical circuits that control the general operation of the tool, the data acquisition systems, the communication systems that connect to telemetry equipment. Other features that may be included in the electronic section (404) are downhole memory for data storage, or other sensors typically found on logging while drilling equipment. The electrical section (404) is electronically linked uphole to telemetry equipment via electrical connector (405). The tool may also include a communication system, which functions to provide a communication link between the tool and other tools located in the drill string, as well as operator(s) at the surface. Other sub-systems may be included which are known in measurement while drilling technology.

Figure 3:
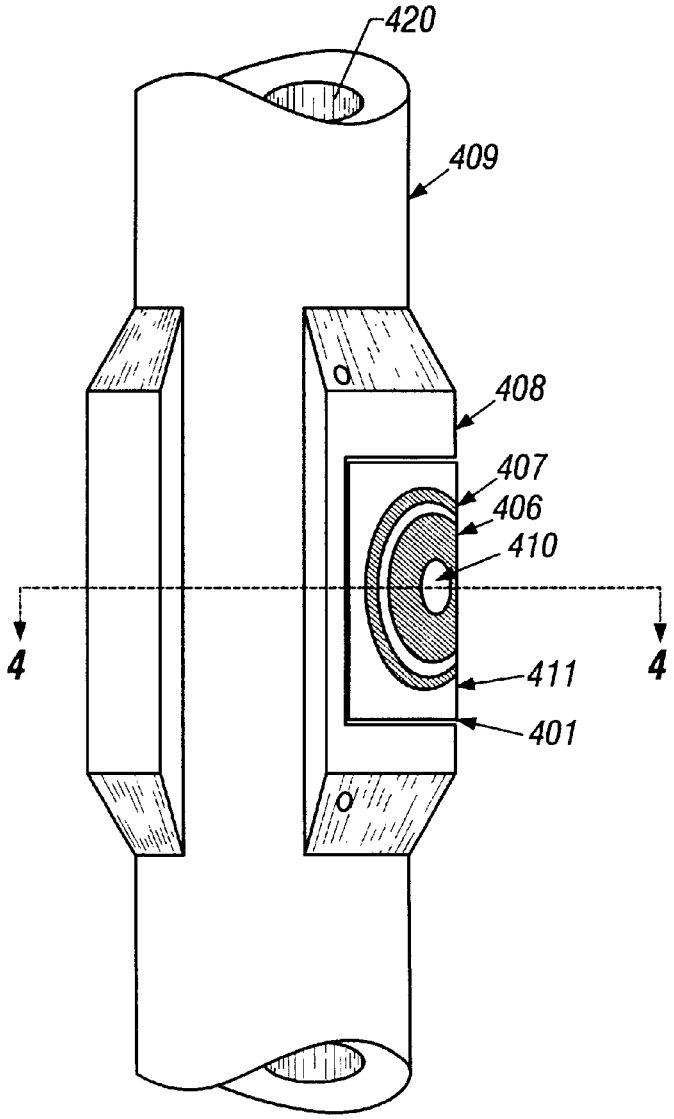

FIG. 3 shows a more detailed external view of the probe section (401) from FIG. 2. In this embodiment, the probe section (401) forms a portion of a stabilizer blade (408) extending radially beyond the drill collar body (409) of the evaluation tool (400). The stabilizer blade and probe section provide the mechanical support and protection to the probe assembly. The probe section (401) is provided with a probe (410), a probe seal (406) and a protector (411) having wear rings (407). The probe section (401) features an internal flow passage (420) to allow the drilling fluids to flow downwardly as indicated by arrow (9) in FIG. 1.

Figure 4:
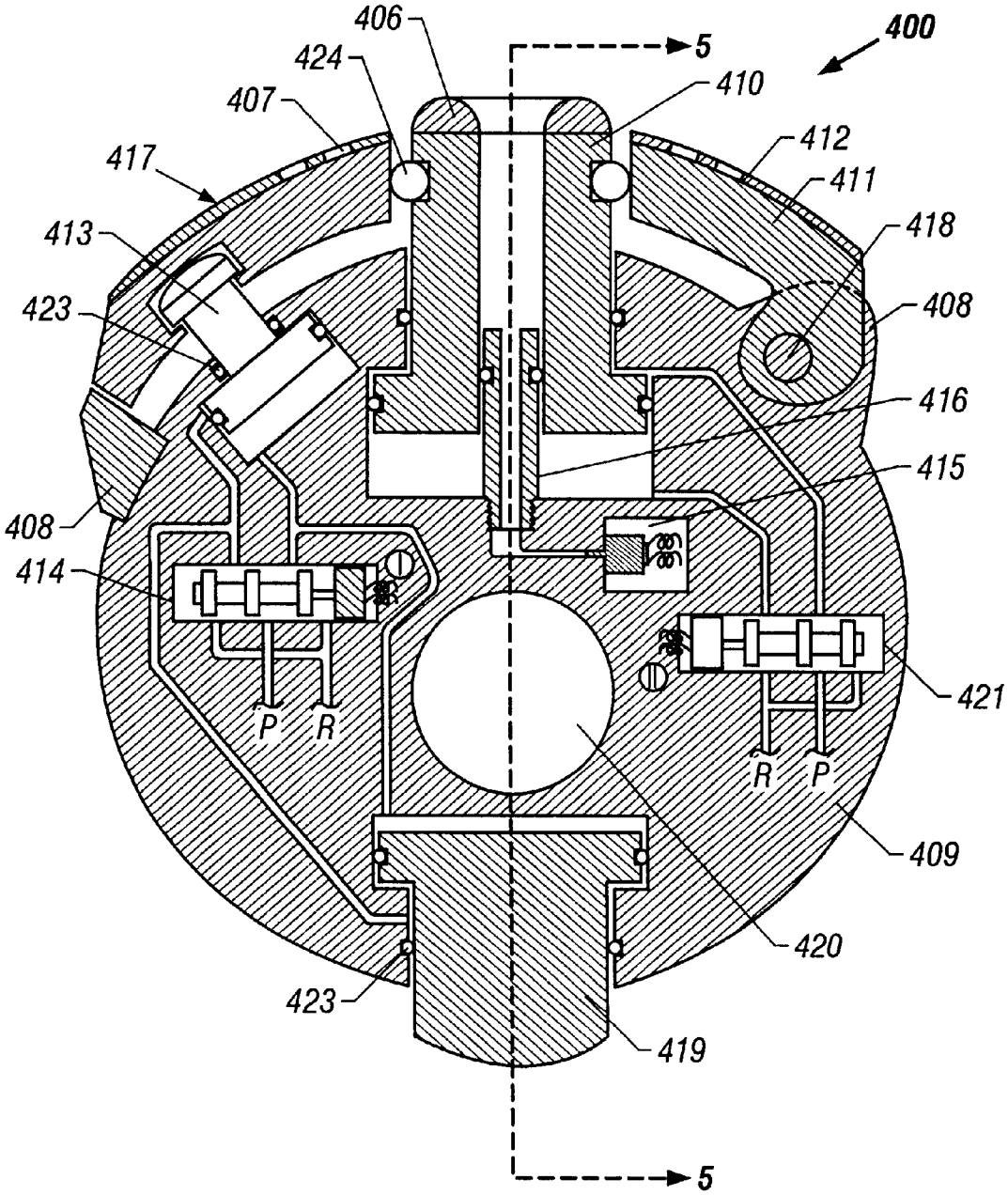
Figure 5:
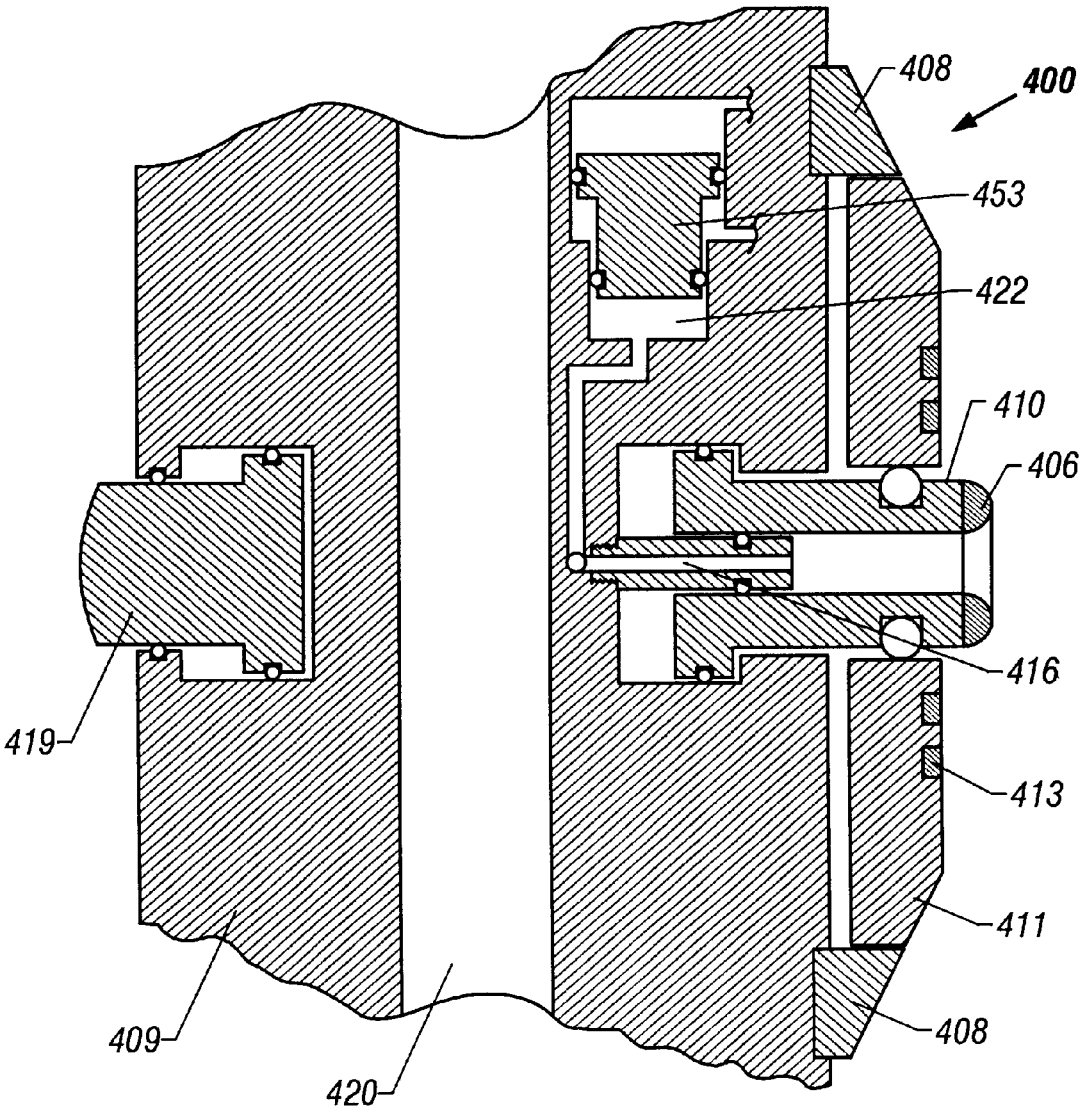

Referring now to FIGS. 4 and 5, the probe section of FIG. 3 is shown in greater detail. FIG. 4 shows a cross sectional view of the drilling tool (400) taken along line 4—4 of FIG. 3. FIG. 5 is a cross sectional view of the drilling tool 400 taken along line 5—5 of FIG. 3. These figures depict the probe (410), the protector (411) and a back-up piston (419), as well as the mechanisms that operate them.

The probe (410) is positioned in the evaluation tool (400) and, in this embodiment, may be extended to contact the borehole wall. Optionally, the probe (410) may be non-extendable and remains solidly attached to the main body (not shown). The probe is capable of performing various downhole data collection functions, such as formation pressure testing and/or sampling. Probes capable of performing various testing and sampling functions are disclosed in U.S. Pat. No. 6,230,557, issued to Ciglenec et al., the entire contents of which is hereby incorporated by reference. The probe (410) is provided with a probe seal (406), often referred to as a packer, capable of sealingly engaging the sidewall of the borehole and creating a hydraulic isolation between the probe and the fluids contained in the annular space of the borehole during the measurement. An electro-hydraulic solenoid valve (421) controls the operation of the probe (410).

Figure 6:
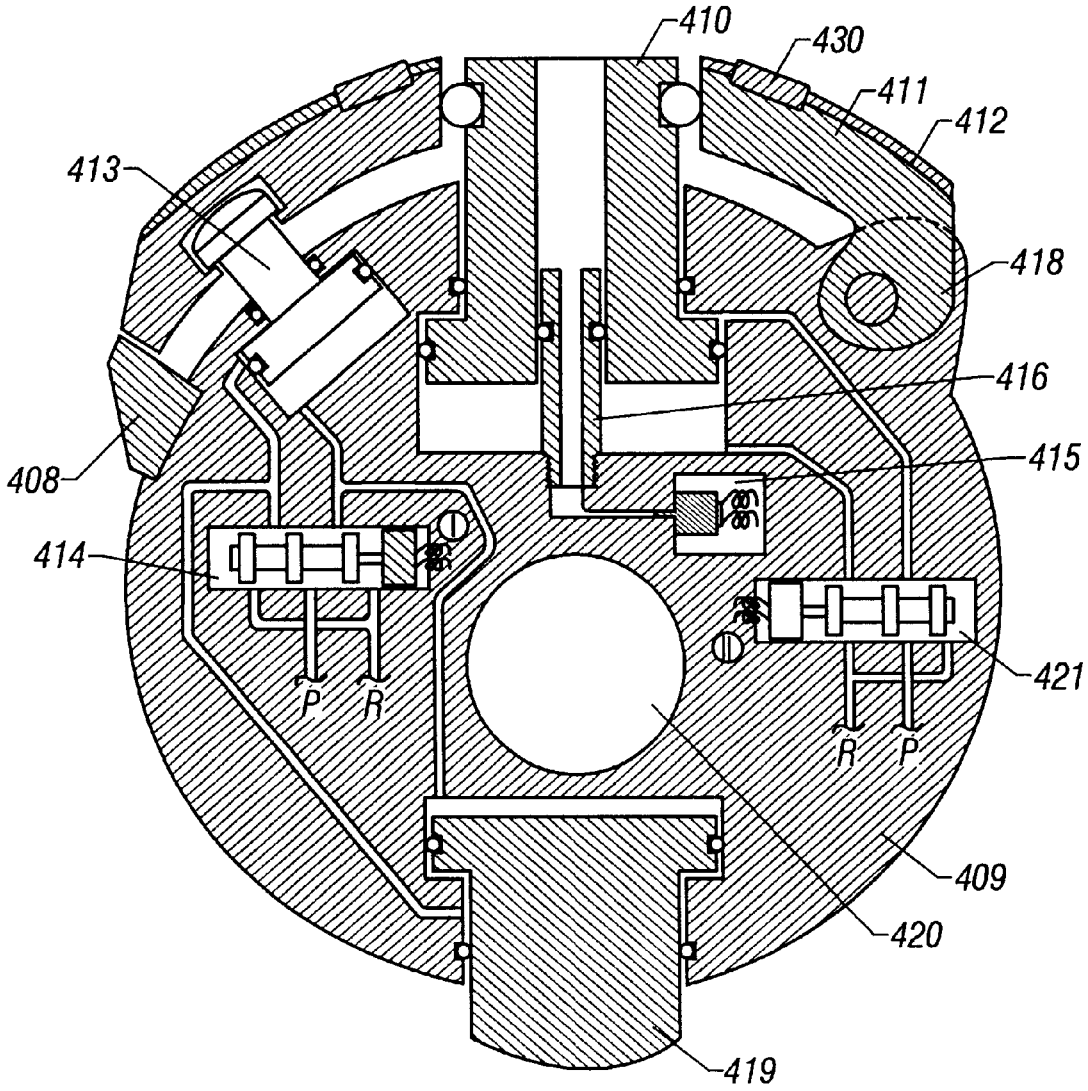

A protector (411) is positioned about the probe and is extendable so as to contact the borehole wall. The protector has at least two functions: to provide a mechanical protection to the probe (410) during the drilling and/or tripping operations and to provide mechanical protection to the mudcake against erosion generated by flowing mud. The protector (411) has a generally arcuate outer surface (417) that may be adapted to conform to the shape of the stabilizer (408) as shown in FIG. 3, and/or the sidewall of the wellbore. The protector is depicted in FIGS. 4 and 5 as being arcuate, but may be any shape capable of conforming to the desired surface. The protector (411) may be provided with a plurality of wear rings (407) and/or a wear-resistant layer (412) made of wear-resistant material, to protect the protector surface against wear during operation. As shown in FIG. 6, the protector (411) may be provided with seals (430) to engage the sidewall of the bore hole and seal therewith. Other shapes and/or patterns of wear rings, seals and protectors can be envisioned.

Referring back to FIG. 4, an extension piston (413) and an electro-hydraulic solenoid valve (414) extend and retract the protector. The protector (411) is articulated around hinge (418), which is mounted on the stabilizer blade (408) of the collar body (409). The protector may be extended and retracted with, before or after the probe. The protector may be connected to, integral with or separate from the probe. As best seen in FIG. 4, the protector is provided with a piston (413) and a hinge (418) to facilitate extension and/or retraction. Other extension mechanisms may be used.

A back up piston (419) is provided in the evaluation tool (400) opposite the protector (411). The back up piston (419) extends to contact the sidewall of the well bore to provide support to the evaluation tool (400) so that the probe (410) and/or protector (411) may extend to and/or through the sidewall of the wellbore and remain in contact therewith during operation. The tool (400) may also include one or more back-up pistons (419), with the purpose of pushing the probe and protector against the borehole face, thus enhancing the ability of the probe seal (406) to seal against the borehole face. Seals (423) are disposed about the pistons and the probe. Seals (424) may also be disposed between the probe and the protector.

Other features that may be used with the evaluation tool (400) include a flow connector (416) positioned inside the probe (410) for providing communication with a pre-test chamber (422) (FIG. 5) and pressure sensor (415) (FIG. 4) by a piston (453) (FIG. 5). The pre-tester, allows samples of fluids to be drawn from or injected into the formation through the probe to test formation parameters, such as pressure and/or permeability as is known in the art, for example by drawing a sample of formation fluid and sensing the pressure drop in the formation. There may also be provided an internal flow passage (420) for mud or other fluids to pass through the tool, and sample chambers (not shown) for taking additional samples of fluid through the probe.

Figure 7:
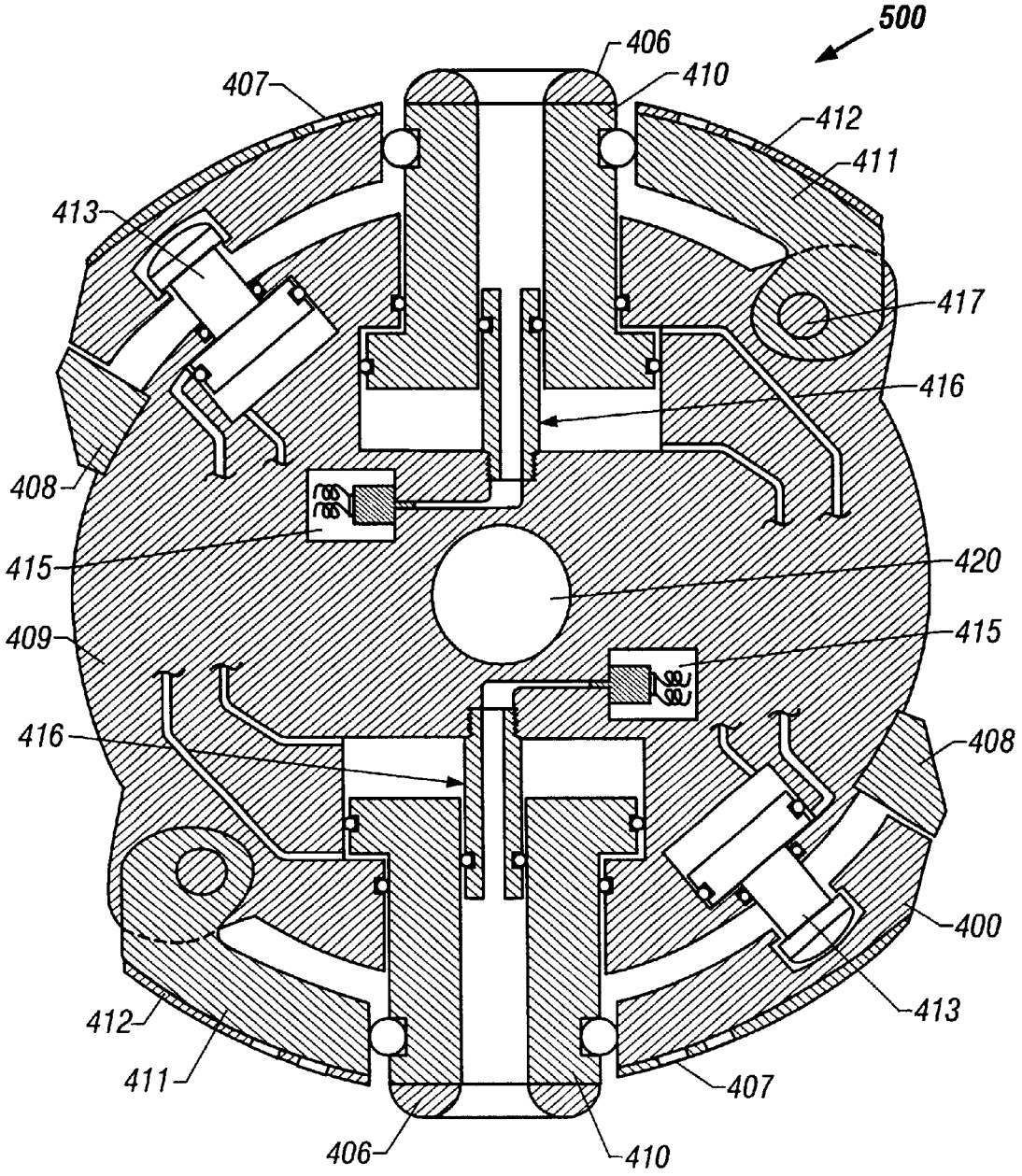

As shown in FIG. 7, in another embodiment, the tool (400) may also include one or more additional sets of probes, probe seals, protectors, and protector extension pistons. FIG. 7 shows a cross sectional view of another embodiment of the evaluation tool (500) having two probe sections (400). The probe sections (400) are as previously described with respect to FIGS. 4 and 5, except that the probe sections are positioned opposite each other thereby providing support to each other previously provided for by the back up piston (419). Where multiple probe sections are disposed about the evaluation tool, the probe sections may be positioned to offset each other as shown in FIG. 7, or be provided with back up pistons positioned to support the probes. The multiple probe sections may be used to perform multiple tests simultaneously or intermittently. Alternatively, probe sections may be used as support or back up for other probe sections during operation.

Figure 8:
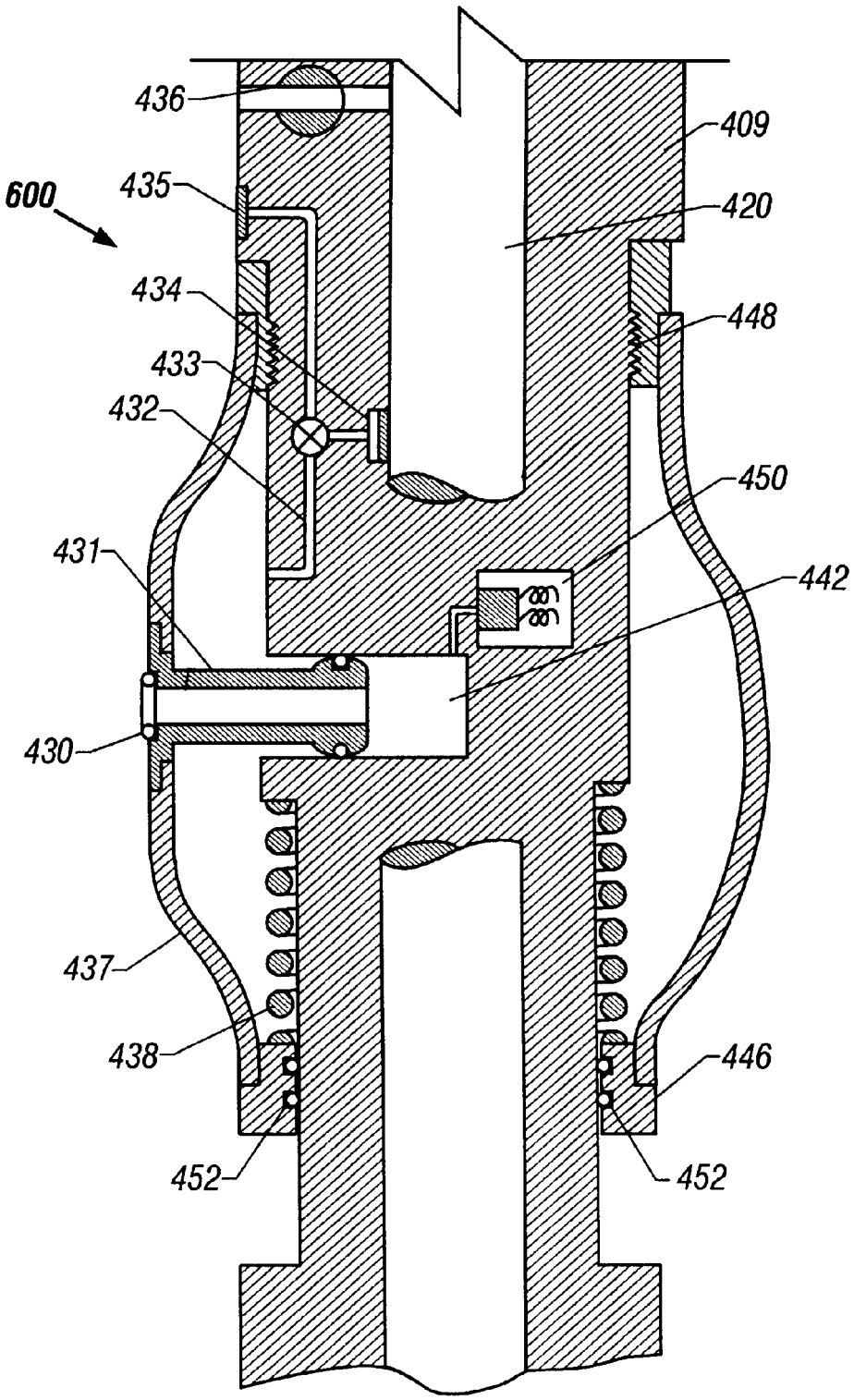

FIG. 8 shows a longitudinal cross sectional view of another embodiment of the invention. An evaluation tool (600) is provided with a probe (431), and a packer (437). The probe (431) is slidably mounted within a chamber (442) in the evaluation tool (400) and extendable therefrom. The probe is provided with a seal (430) at one end thereof positionable in contact the sidewall of the borehole and/or extending therethrough. The probe may be used to sample, test and/or collect data.

The inflatable packer (437) is positioned about the probe and the drill collar body (409). The packer (437) may be provided with at least three functions: sealing the probe to the borehole, providing back up support to the probe and/or protecting the borehole surrounding the probe. In this embodiment, the packer is provided with movable ring (446) at a downhole end thereof, and a spring (438). An uphole end of the packer (437) may be fixed to the drill collar body (409) by any method, but a threaded connection (448) is shown here. The ring (446) is axially movable along the drill collar body (409). When the packer is inflated, the ring (446) moves uphole, the spring (438) is placed under compression and the packer (437) begins to extend radially outward to contact the sidewall of the wellbore. When the packer is deflated, the ring (446) moves downhole under the action of the spring (438) and the packer retracts. The inflation and retraction of the packer (437) is used to extend and retract the probe (431).

The pressure source necessary to inflate the packer (437) can be provided by the fluid circulating in the flow passage (420). Flow passage (420) is hydraulically connected to an inlet port (434) which is connected to a three way valve (433). The three way valve (433) can selectively inflate the rubber element (437). When the rubber element (437) is to be inflated, fluid from the flow passage (420) flows through the inlet port (434), through the three way valve (433), and through the set line (432).

In the inflated/extended position, the probe seal (430) seals against the inner wall of the borehole (not shown) so that fluid samples from the formation can be tested. When the rubber element (437) is to be deflated, the three way valve (433) is unlocked and the spring (438) urges the sliding ring (446) down and serves to deflate the rubber element (437), which allows the fluid inside the rubber element (437) to flow through the three way valve (433) and out the outlet port (435) to the annular space in the borehole.

One or more seals (452) may be provided on the sliding ring (446) and/or the probe. When the packer (437) is fully inflated, drilling fluid circulation through the inside of the drill string (12) may be maintained by opening by pass valve (436) thereby allowing the fluid to flow directly from the inside of drill string (12) to the annular space between the drill string (1) and the borehole (11). The by pass valve (436) will be closed when the packer (437) is deflated thereby restoring the fluid circulation down the bottomhole assembly (100) and the bit (15)

When the rubber element (437) is fully inflated and the probe seal (430) is sealed against the inner wall of the borehole fluid samples can be passed through the probe (431) and flow into a pressure sensor (450) through the chamber (442). After the packer (437) has been fully inflated, the three way valve (433) locks and the rubber element (437) stays inflated.

To collapse the packer, the three way valve may be unlocked to release the internal pressure. The process may then be repeated as desired.

Figure 9:
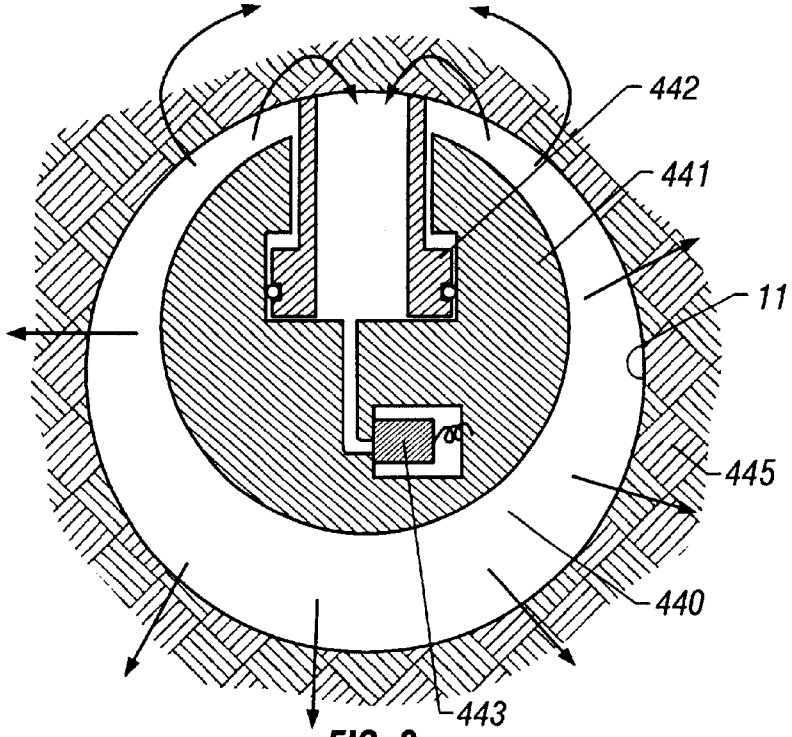
FIG. 9 (Prior Art)
Figure 10:
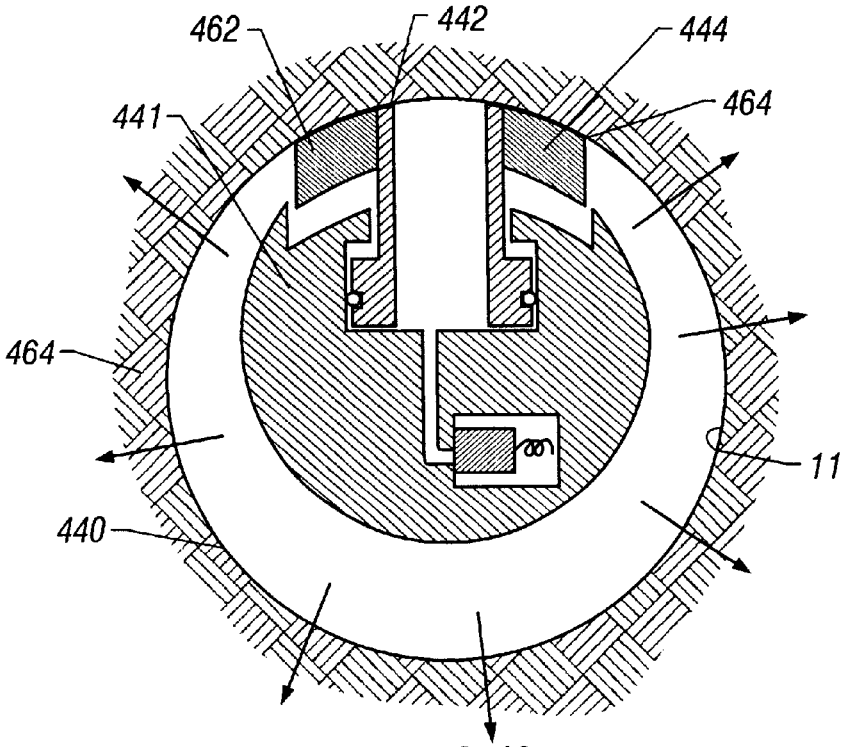

FIGS. 9 and 10 illustrates the situation that can arise when making a pressure measurement or taking a sample from the formation using a conventional prior art tool. As a consequence to the dynamic erosion generated by the mud circulating in the annular space (440), more fluid is allowed to filtrate into the formation (445), as indicated by the arrows, altering the formation characteristics in the well bore vicinity, including the area around the probe (442). The fluid that filtered into the formation (445) may have a detrimental impact on the measurement performed by the sensor (443).

Another embodiment of the invention is illustrated by FIG. 10 which shows the effects of the protector (444) on the measurement. The protector (444) helps to prevent the drilling fluids from percolating into the formation (445) in the area around the probe (442). The protector (444) allows the sensor to sense an area of the formation that is less affected by the fluid circulation, which may act to improve the quality of the measurements. The protector (444) provides a barrier that prevents drilling fluids to enter the formation (443) around probe (442).

In another embodiment, a tool measuring formation pressure may include the following components: a probe assembly that can be deployed from the body of the tool in order to seal against the formation wall. In another embodiment of the invention, the probe is directly mounted on the protector. The tool may also include a protector that functions to mechanically protect the borehole area surrounding the extensible probe from the effects of dynamic erosion, before and during the measurement phases, thus reducing the effects of supercharging on the pressure measurement. In another embodiment of the invention, the protector features a flexible inflatable element that carries the measuring probe. In another embodiment of the invention, a probe is carried by a protector. In another embodiment, the tool is mounted on a non-rotating sleeve, so that it may be possible to make measurements without interrupting the drilling operation.

In another embodiment of the invention, there is provided a method for measuring formation pressure. During the course of drilling a well, it may be necessary at a given moment to evaluate the pore pressure of a formation that either is in the process of being drilled, or may have just been drilled by the bottom hole assembly. This information can be used for the purpose of improving drilling operations, acquiring more knowledge of the potential oil-producing capabilities of the formation being drilled or for other reasons. One possible procedure would be to require the evaluation tool to perform a pressure measurement each time the circulation is interrupted. The next phase may require the driller to temporarily interrupt the drilling process in order to position the measuring probe of the evaluation tool at the desired location where the measurement will take place. This operation may involve translating the drilling string axially in order to locate the tool at the proper depth, and may also involve rotating the drilling string in order to achieve a specific tool face orientation angle relative to the vertical reference.

Once the drill string has been properly located and oriented, the measurement process can be initiated. In some instances depending on the well conditions, it will be necessary to add additional time to allow for the bottom hole assembly to fully stabilize before commencing the measurement. In order to initiate the measurement, the circulation of mud through the drilling pipe may be interrupted, which informs the tool to begin the automatic process of formation pressure measurement. If the circulation of mud is interrupted, the moment at which the pumps were stopped may be recorded. Various methods are known and can be used to perform the measurement. For example, one method may involve the deployment of a probe that will press against the side of the borehole to achieve a hydraulic connection with the reservoir formation. Once the hydraulic connection is established, the mud circulation can be resumed, or left interrupted.

The tool may then perform the pressure measurement. A limit to the duration of the measurement may be preprogrammed in the tool. Once the preset time has elapsed, the tool may automatically reset itself to the initial condition. The preset time limit can be adjusted by the tool operator depending on the expected characteristics of the formation being evaluated, as well as various other drilling considerations. At the end of the measurement measurement time, the tool may have been able to acquire information about the pore pressure of the formation being probed, as well as other parameters common to reservoir evaluation such as pressure drawdown and pressure build-up curves. This information may be stored in the tool for further processing before being transmitted to the operator on surface.

An alternate method to terminate the measurement may be to provide a logic circuitry inside the tool that will stop formation parameter acquisition upon detecting that pump circulation has been resumed. Upon confirmation of the reset status of the tool, drilling operations can be resumed, or a new measurement can be performed. If drilling is resumed, more detailed data such as the pressure profiles may be sent to the surface using the conventional uplink telemetry procedure.

While the invention has been described using a limited number of embodiments, those skilled in the art, having the benefit of this disclosure, will appreciate that other variations are possible without departing from the scope of the invention as disclosed herein. Accordingly, the scope of the invention should be limited only by the attached claims.

What is claimed is:

1. A downhole tool for collecting data from a subsurface formation, comprising:

a housing positionable in a wellbore penetrating the subsurface formation;

a probe carried by the housing, the probe having a probe seal for sealing engagement with the sidewall of the wellbore, the probe adapted to establish fluid communication between the downhole tool and the formation; and a protector positioned about the probe, the protector adapted for movement between a retracted position adjacent the housing and an extended position engaging the sidewall of the wellbore, the protector having an outer surface adapted to engage the sidewall of the wellbore whereby the wellbore surrounding the probe is protected.

2. The downhole tool of claim 1 wherein the probe is extendable from the housing.

3. The downhole tool of claim 1 wherein the outer surface of the protector is provided with wear rings.

4. The downhole tool of claim 1 wherein the outer surface of the protector is provided with a protector seal for sealingly engaging the sidewall of the wellbore.

5. The downhole tool of claim 1 further comprising a pre-tester.

6. The downhole tool of claim 1 further comprising a back up piston.

7. The downhole tool of claim 1 wherein the interrelationship between the probe and protector is selected from the group of connected, integral and separate.

8. The downhole tool of claim 1 further comprising a first actuator for extending and retracting the probe and a second actuator for extending and retracting the protector.

9. The downhole tool of claim 1 further comprising a ring, a spring connected to the ring and an inflator, the ring connected to an end of the protector and axially movable along the housing between a downhole position wherein the protector is retracted and an uphole position wherein the protector is extended, the inflator adapted to inflate the protector with the ring in the uphole position whereby the protector sealingly engages the sidewall of the wellbore.

10. A downhole tool for collecting data from a subsurface formation, comprising:

a housing adapted for axial connection in a drill string positioned in a wellbore penetrating the subsurface formation;

a probe carried by the housing, the probe having a probe seal positionable adjacent the sidewall of the wellbore for sealing engagement therewith; and a protector positioned about the probe, the protector operatively coupled to an actuator, wherein the protector is adapted for movement between a retracted position adjacent the housing and an extended position engaging the sidewall of the wellbore whereby the wellbore surrounding the probe is protected.

11. The downhole tool of claim 10, further comprising a plurality of stabilizer blades.

12. The downhole tool of claim 10, wherein the probe comprises:

a conduit having an open end positioned for fluid communication with a central opening in the probe seal; and a filter valve positioned in the central opening of the sealing apparatus about the open end of the conduit, the filter valve being movable between a first position closing the open end of the conduit and a second position permitting filtered formation fluid flow between the formation and the conduit.

13. The downhole tool of claim 12, wherein the actuator comprises:

a hydraulic fluid system;

a means for selectively pressurizing the hydraulic fluid in the hydraulic fluid system; and an expandable bellows in fluid communication with the hydraulic fluid system and connected to the probe seal, the bellows being expanded with increased pressure in the hydraulic fluid to move the probe seal into sealed engagement with the wellbore wall.

14. The downhole tool of claim 12, wherein the actuator comprises:

a hydraulic fluid system;

a means for selectively pressurizing hydraulic fluid in the hydraulic fluid system; and an expandable vessel in fluid communication with the hydraulic fluid system, the vessel being expanded with increased pressure in the hydraulic fluid and contracted with decreased pressure in the hydraulic fluid.

15. The downhole tool of claim 13, wherein the actuator further comprises a sequence valve that operates upon sensing a predetermined pressure in the hydraulic fluid resulting from maximum expansion of the bellows to move the filter valve to the second position whereby fluid in the formation can flow into the open and of the conduit.

16. The downhole tool of claim 12, further comprising a sensor placed in fluid communication with the conduit for measuring a property of the formation fluid.

17. The downhole tool of claim 16, wherein the sensor comprises a pressure sensor adapted for sensing the pressure of the formation fluid.

18. The downhole tool of claim 10, wherein the downhole tool comprises a non-rotating stabilizer.

19. The downhole tool of claim 10, further comprising at least one back-up piston adapted to push the probe and the protector against a wall of the borehole.

20. The downhole tool of claim 10, wherein the protector further comprises a wear ring and a wear resistant layer.

21. The downhole tool of claim 10, wherein the protector further comprises a plurality of wear rings and a wear resistant layer.

22. The downhole tool of claim 10, wherein the probe is movable between a retracted position adjacent the housing and an extended position adjacent the sidewall of the wellbore.

23. The downhole tool of claim 22, wherein the actuator is adapted to move the probe between the retracted and extended position.

24. A downhole tool for collecting data from a subsurface formation, comprising:

a tubular mandrel adapted for axial connection in a drill string positioned in a wellbore penetrating the subsurface formation;

a stabilizer element positioned about the tubular mandrel for relative rotation between the stabilixer element and the tubular mandrel;

a plurality of elongated ribs connected to the stabilizer element for frictional engagement with a wall of the wellbore, such frictional engagement preventing the stabilizer element from rotating relative to the wellbore wall;

an actuator system carried at least partially by the stabilizer element;

a probe carried by one of the elongated ribs and adapted for movement by the actuator system between a retracted position within the one rib and an extended position engaging the wellbore wall such that the probe collects data from the formation;

a probe seal positioned about the probe and adapted for movement by the actuator system between a retracted position within the rib and an extended position engaging the wellbore wall such that the probe seal forms a seal with the wellbore wall; and a protector positioned about the probe seal.

25. A method for measuring a property of fluid present in a subsurface formation, comprising:

positioning a downhole tool in a wellbore penetrating the subsurface formation, the downhole tool having a probe adapted to collect data from the formation, the probe having a probe seal;

moving the probe seal into sealing engagement with the wellbore wall;

positioning a protector into sealed engagement with the wellbore wall surrounding the probe; and collecting data from the formation.

26. The method of claim 25, wherein the step of collecting data comprises sampling fluid from the formation.

27. The method of claim 26, wherein the step of collecting data comprises testing formation parameters.

28. A downhole tool for collecting data from a subsurface formation, comprising:

a housing adapted for axial connection in a drill string positioned in a borehole penetrating the subsurface formation;

a probe connected to the housing and adapted to collect data from a subsurface formation, the probe having a probe seal for sealing engagement with a wall of the borehole; and a protector connected to the housing and about the probe, the protector adapted to protect the borehole surrounding the probe.

* * * * *